US011833400B1

(12) United States Patent
Reynolds

(10) Patent No.: US 11,833,400 B1
(45) Date of Patent: Dec. 5, 2023

(54) CORNHOLE TRAINING DEVICE

(71) Applicant: Jeff Reynolds, Garrettsville, OH (US)

(72) Inventor: Jeff Reynolds, Garrettsville, OH (US)

( * ) Notice: Subject to any disclaimer, the term of this patent is extended or adjusted under 35 U.S.C. 154(b) by 0 days.

(21) Appl. No.: 18/169,640

(22) Filed: Feb. 15, 2023

(51) Int. Cl.
*A63B 69/00* (2006.01)
*A63B 67/06* (2006.01)

(52) U.S. Cl.
CPC ..... *A63B 69/00* (2013.01); *A63B 67/06* (2013.01); *A63B 2209/10* (2013.01); *A63B 2225/055* (2013.01)

(58) Field of Classification Search
CPC . A63B 2037/082; A63B 43/005; A63B 67/06; A63B 69/00; A63F 2009/023; F16B 47/00
See application file for complete search history.

(56) References Cited

U.S. PATENT DOCUMENTS

| | | | | |
|---|---|---|---|---|
| 3,565,305 | A * | 2/1971 | Belokin, Jr. | B60R 9/065 224/319 |
| 7,444,697 | B2 * | 11/2008 | Williams | A47C 7/0213 5/636 |
| 9,185,989 | B1 * | 11/2015 | Parsons | B60J 3/0247 |
| D944,328 | S * | 2/2022 | Spady | D21/303 |
| 2020/0406114 | A1 * | 12/2020 | Spady | A63B 63/08 |
| 2021/0146210 | A1 * | 5/2021 | Roberts, Jr. | A63B 67/06 |

FOREIGN PATENT DOCUMENTS

| | | | | |
|---|---|---|---|---|
| DE | 202013002133 | U1 * | 5/2013 | F21S 41/435 |

OTHER PUBLICATIONS

English machine translation of DE-202013002133-U1 (Secerov) (Year: 2013).*
Ultra Cornhole Trainer Pro, https://ultracornhole.com/product/ultra-trainer-pro/, archived by the Internet Archive on Jun. 20, 2019 (Year: 2019).*
Native Cornhole, Airmail 5000, https://www.facebook.com/nativecornhole/videos/airmail5000-httpsnativecornholecomproductsairmail-5000_pos1_sid110fef0da_ssr/1864358313697235/, posted on Feb. 27, 2020 (Year: 2020).*

* cited by examiner

*Primary Examiner* — Laura Davison
(74) *Attorney, Agent, or Firm* — Brennan, Manna & Diamond, LLC

(57) ABSTRACT

A cornhole training device for simulating practice scenarios involving a blocking bag positional a cornhole game board. The cornhole training device integrates a suction component and a stabilizing plate with a cornhole bag. The stabilizing plate is retained within a pocket attached to an inside of the cornhole bag with the suction component extending through the pocket, the stabilizing plate, and the cornhole bag. The suction component attaches to and engages the cornhole gameboard surface. Alternatively, the device is configured to attach the suction component, the stabilizing plate, and the pocket to an existing cornhole bag. The cornhole training device is positional anywhere on the gameboard to simulate a cornhole bag obstructing the aperture.

20 Claims, 11 Drawing Sheets

CORNHOLE TRAINING DEVICE

FIELD OF THE INVENTION

The present invention generally relates to a training aid for a bag toss game, and more specifically to a cornhole training device for improving play skills related to the game of cornhole. Accordingly, the present specification makes specific reference thereto. However, it is to be appreciated that aspects of the present invention are also equally amenable to other like applications, devices, and methods of manufacture.

BACKGROUND

Cornhole is a lawn game where players take turns throwing sixteen ounce bags at an inclined slanted wooden platform. The game targeting structure or platform, known as a board, has a circular aperture near the far end of the board for receiving a successfully tossed bag. A bag tossed into the hole is credited with three points, while a bag that lands and stays on the board surface the board is awarded one point. The game is won when a team or player reaches or exceeds a score of twenty-one by means of cancellation scoring. In cancellation scoring, the points of one player or team cancel out the points of their opponent. Cancellation scoring allows only one player or team to score in each inning.

Each set of cornhole bags consist of four bags which are distinguishable from the other, typically by color or other external indicia. Although the cornhole bags were originally filled with corn kernels giving the game its name, cornhole bags are now typically filled with a plastic resin or similar granular material to maintain a consistent weight and shape. The cornhole bags are approximately six inch by six inch fabric covered bags weighing between approximately 15.5 to 16.5 ounces when filled.

Each cornhole gameboard is approximately two feet wide and four feet long with a six inch hole centered nine inches from the top of the board. Each board is angled or inclined so that the top edge of the board playing surface is elevated by a pair of legs twelve inches above the ground. The foot of the board rests on the ground with the bottom edge of the board playing surface between three and four inches above the ground. Two boards are placed so that the bottom edges of the boards are inline and approximately twenty seven feet apart, with the aperture holes separated by approximately thirty three feet which forms a cornhole court. The cornhole bags are tossed by players from a rectangular area directly to the left or right of a board without a player stepping past the bottom of the board during a toss.

Cornhole matches are broken down into frames of play known as innings. Each player tosses or pitches four bags, alternating teams between each throw to complete an inning. A player must deliver the cornhole baa from either the left or right rectangular area directly to the left or right of a board known as a pitcher's box without stepping outside of the box. Opponents never throw from the same pitcher's box during a frame.

A cornhole bag must either be tossed through the hole or land on the board to score points. The bags can be tossed directly into the hole, slide into the hole after hitting the board, or be knocked into the hole by another bag on a different toss. Bags touching the ground before landing on the board are removed from the board prior to continuation of play and not worth any, points. Scoring is done by cancellation (e.g., if one player scores six points in the frame and the other player scores four points in the same frame, the first player receives two points). The game ends when a player or team reaches or exceeds twenty one points.

The game or cornhole has become very popular and competitive. Gameplay strategy varies by player and skill level. It is not uncommon for professional players to slide all of their bags into the hole if no bag blocks the path in each inning. Defensive strategies have been developed to slow down game play or force opponents to make tactical decisions. One common defensive strategy employs using a blocking bag. The player throws a bag aimed to intentionally rest in front of the hole instead of scoring through the aperture. This blocking bag forces an opponent to attempt to either slide through the blocker bag into the hole, throw another blocker behind the first blocker bag, or attempt a riskier "airmail" shot over the blocker bag (throwing directly through the hole without first touching the board). The airmail shot is typically more difficult to achieve than a sliding shot.

Accordingly, there is a great need for a way for cornhole players to improve their playing skills. There is also a need for a way for teach cornhole players how to deal with a blocking bag. Similarly, there is a need for a training tool that replicates a blocking bag in place on a cornhole board. Further, there is a need for a training device that is adjustable to simulate scenarios where a blocking bag or multiple blocking bags are placed at different positions on a cornhole board.

In this manner, the improved cornhole training device of the present invention accomplishes all of the forgoing objectives, thereby providing an easy solution for improving cornhole playing skills. A primary feature of the present invention is a training device for use with a cornhole board. The present invention allows a user to replicate a scenario where a blocking bag is in place on a cornhole board in front of the hole. Finally, the improved training apparatus of the present invention is capable of allowing a player to simulate different blocking bag scenarios to improve their cornhole skills and create a practice platform for airmail type shots.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a cornhole training device. The cornhole training device is adapted for use with a cornhole gameboard. The cornhole training device is temporarily positional and attachable anywhere on the cornhole game board to allow the player to practice a variety of different shots under a variety of playing scenarios.

The cornhole training device comprises a suction component, a stabilizing plate, and stabilizing plate retaining pocket. The cornhole training device further comprises a cornhole bag. Alternatively, the cornhole training device further comprises a cornhole receiving bag for encapsulating a cornhole bag. The suction component is configured to engage the cornhole gameboard holding the cornhole training device in place on a top surface of the cornhole gameboard. The suction component comprises a concave side, a convex side, and an attachment component. The concave side is configured to secure the cornhole training device to the cornhole board via suction.

The attachment component comprises a center portion and a connector element. The center portion is integrated into the suction component. The connector element extends out of the center portion from the convex side. The attachment component may further comprise a spacer element and a securing element. The spacing element is configured to fit over the connector element and the securing element engages the connector element.

The stabilizing plate is a generally rectangular plate. The stabilizing plate comprises a plate through hole. The plate through hole is positioned off center on the stabilizing plate. The stabilizing plate retaining pocket comprises a pocket through hole. The stabilizing plate is positional within the stabilizing plate retaining pocket so that the plate through hole and the pocket through hole are aligned. The stabilizing plate retaining pocket is securable to an interior surface of the cornhole bag. Alternatively, the stabilizing plate retaining pocket is securable to an interior surface of the cornhole receiving bag.

The suction component is positioned so that the convex side abuts an exterior surface of the cornhole bag or the cornhole receiving bag. The cornhole bag and the cornhole receiving bag each comprise a through hole on a board engaging side of the cornhole bag or the cornhole receiving bag. The connector element of the attachment component penetrates the through hole of the cornhole bag or the cornhole receiving bag. The connector element further penetrates the pocket through hole and the plate through hole. The connector element extends through the stabilizing plate and spacer element and be secured with the securing element. Alternatively, the connector element may secure directly to the stabilizing plate.

In another embodiment, the subject matter disclosed and claimed herein comprises a cornhole training device. The cornhole training device is adapted for use with a cornhole bag and a cornhole gameboard. The cornhole training device comprises a suction component, a stabilizing plate, and stabilizing plate retaining pocket. The suction component is configured to engage the cornhole gameboard holding the cornhole bag and the cornhole training device in place on a top surface of the cornhole gameboard. The suction component comprises a concave side, a convex side, and an attachment component. The concave side is configured to secure the cornhole training device to the cornhole board via suction.

The attachment component comprises a center portion and a connector element. The center portion is integrated into the suction component. The connector element extends out of the center portion from the convex side. The attachment component may further comprise a spacer element and a securing element. The spacing element is configured to fit over the connector element and the securing element engages the connector element.

The stabilizing plate is a generally rectangular plate. The stabilizing plate comprises a plate through hole. The plate through hole is positioned off center on the stabilizing plate. The stabilizing plate retaining pocket comprises a pocket through hole. The stabilizing plate is positional within the stabilizing plate retaining pocket so that the plate through hole and the pocket through hole are aligned. The stabilizing plate retaining pocket is removably securable to an exterior surface of the cornhole bag on the opposite side of the side with the pocket through hole.

The suction component is positioned so that the convex side abuts an exterior surface of the cornhole bag. The connector element of the attachment component penetrates both the pocket through hole and the plate through hole. The connector element extends through the stabilizing plate and spacer element and be secured with the securing element. Alternatively, the connector element may secure directly to the stabilizing plate.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
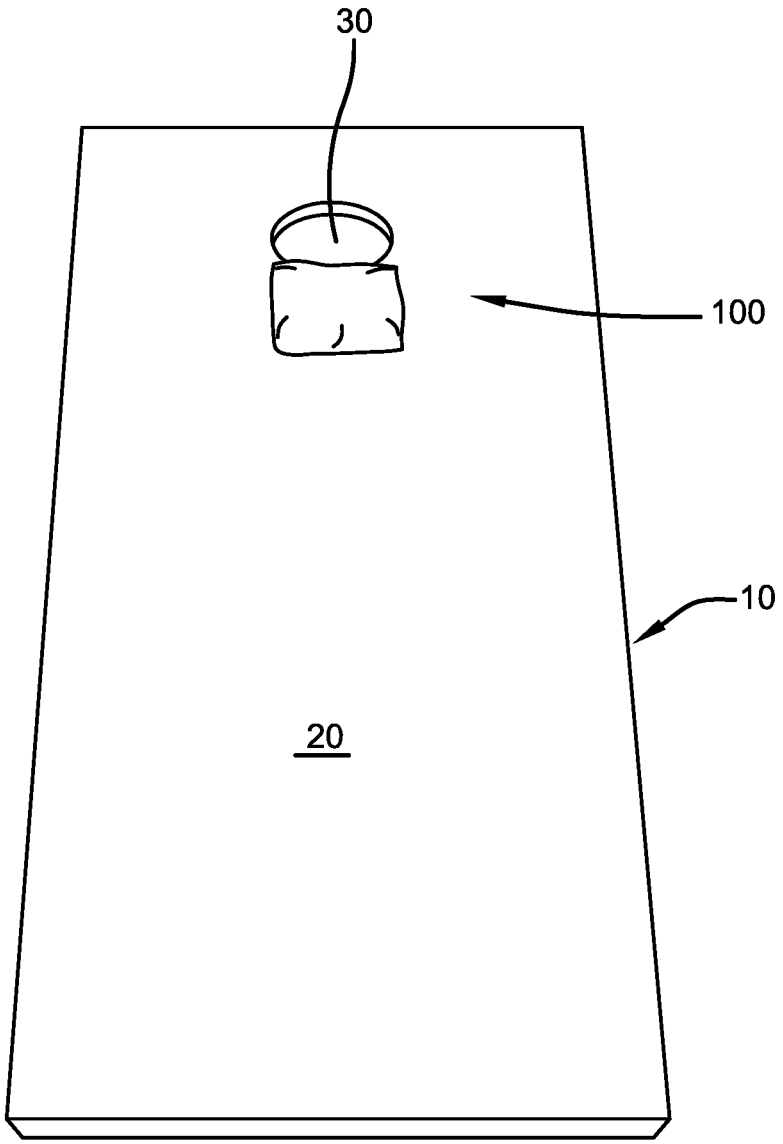
FIG. 1 illustrates an overhead perspective view of a cornhole training device of the present invention for use with a cornhole game board attached to the cornhole game board in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

Referring initially to the drawings, FIGS. 1-10 illustrate a cornhole training device 100. The cornhole training device 100 is adapted for use with a standard cornhole gameboard 10 as illustrated in FIG. 1. The cornhole training device 100 is designed to allow a player to practice a variety of different shots in the game of cornhole. The cornhole training device 100 can be positioned anywhere on a top surface 20 of the cornhole game board 10 to allow the player to practice cut shots, roll and bounce shots, air mail shots, and the like under a variety of playing scenarios. The cornhole training device 100 may be positioned to block the aperture 30 or hole in the cornhole gameboard 10. The cornhole training device 100 is temporarily attachable to the cornhole game board 10 via suction. Further, as illustrated in FIG. 11, a plurality of the cornhole training devices 100 may be positioned simultaneously at multiple locations on the cornhole gameboard 10.

Figure 2:
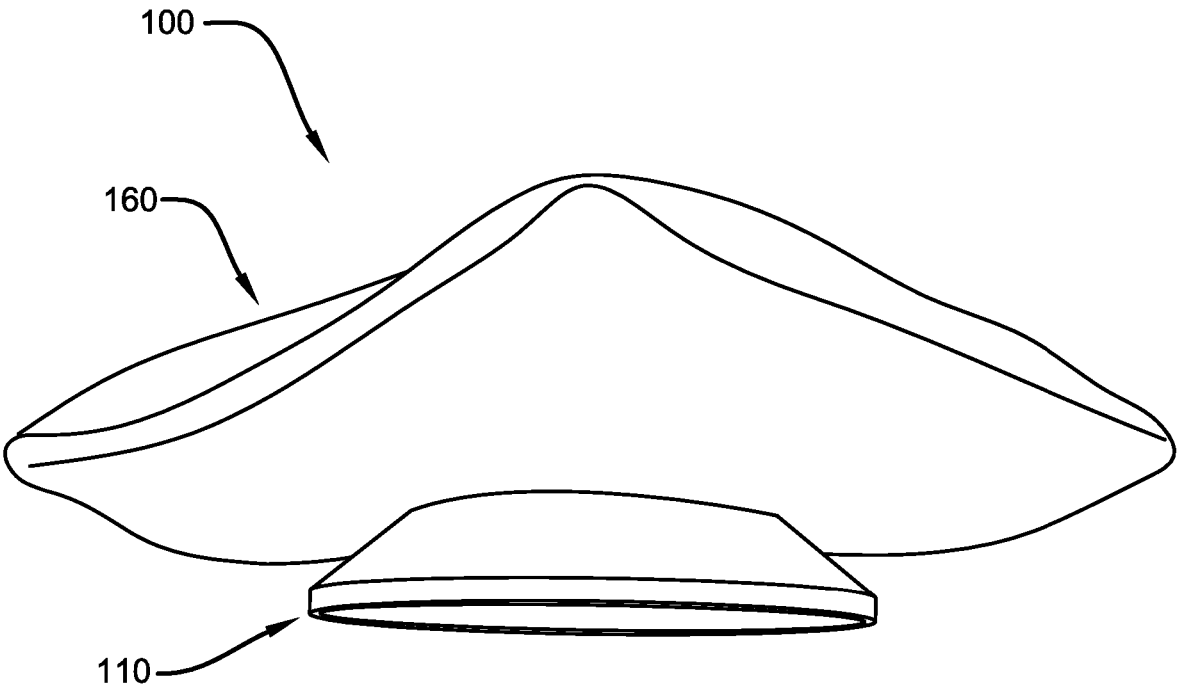
FIG. 2 illustrates a side perspective view of the cornhole training device of the present invention for use with the cornhole game board in accordance with the disclosed architecture.
Figure 3:
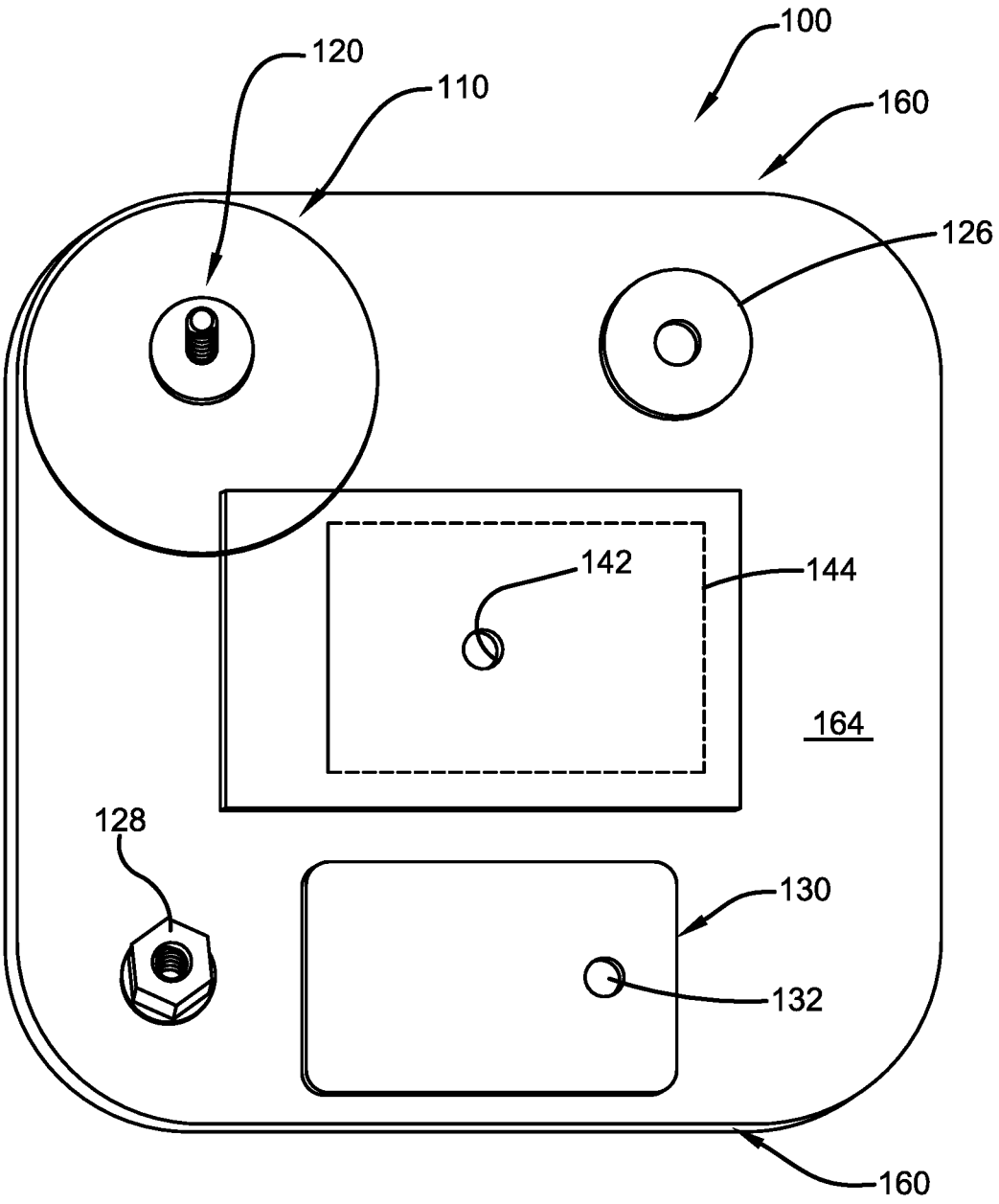
FIG. 3 illustrates a perspective view of various components of the cornhole training device disassembled of the present invention for use with the cornhole game board in accordance with the disclosed architecture.
Figure 4:
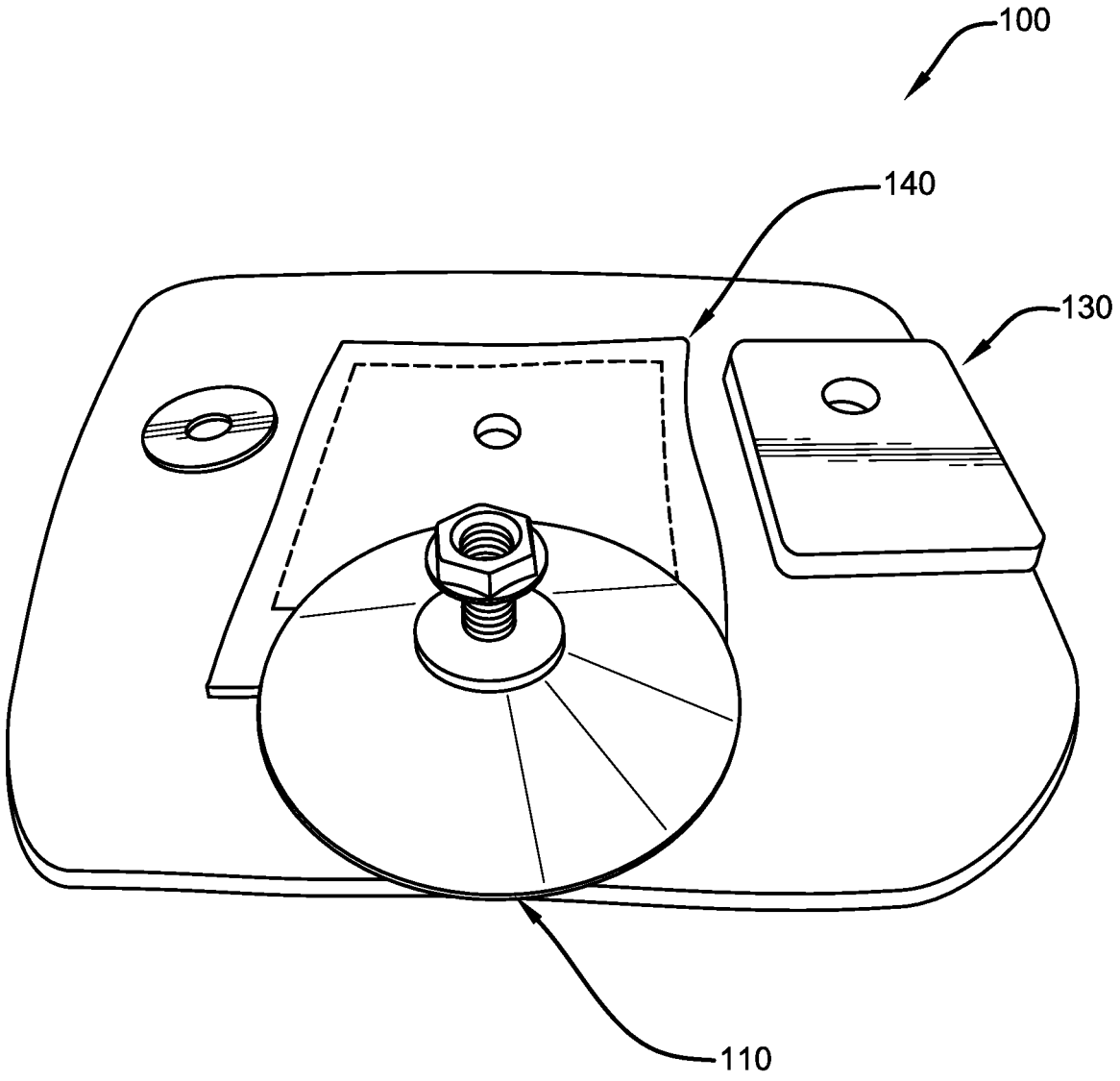
FIG. 4 illustrates a perspective view of various components of the cornhole training device disassembled of the present invention for use with the cornhole game board in accordance with the disclosed architecture.
Figure 9:
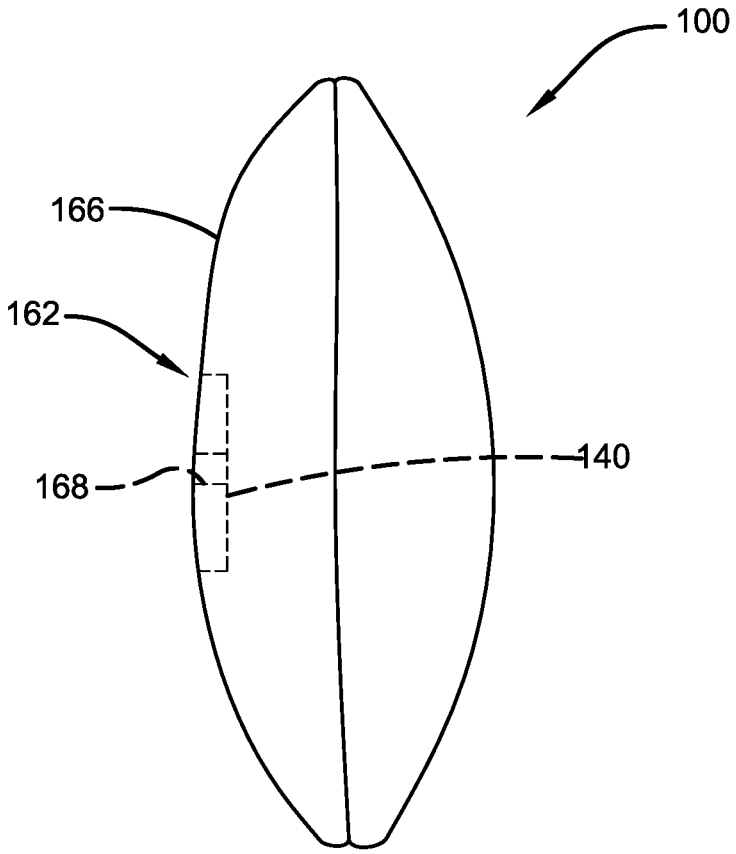
FIG. 9 illustrates a side cutaway view of the cornhole training device of the present invention for use with the cornhole game board in accordance with the disclosed architecture.

As illustrated in FIGS. 2-4, the cornhole training device 100 comprises a suction component 110, a stabilizing plate 130, and stabilizing plate retaining pocket 140. The cornhole training device 100 may further comprise a cornhole bag 160. The cornhole bag 160 may be any traditional cornhole bag constructed from a fabric or pliable material usable to encapsulate a filling material. The cornhole bag 160 is incompletely constructed while the cornhole training device 100 is being assembled. As illustrated in FIG. 9, a cornhole board engaging side 162 of the cornhole bag 160 comprises an interior surface 164 and an exterior surface 166. A bag through hole 168 penetrates the cornhole board engaging side 162.

Figure 10:
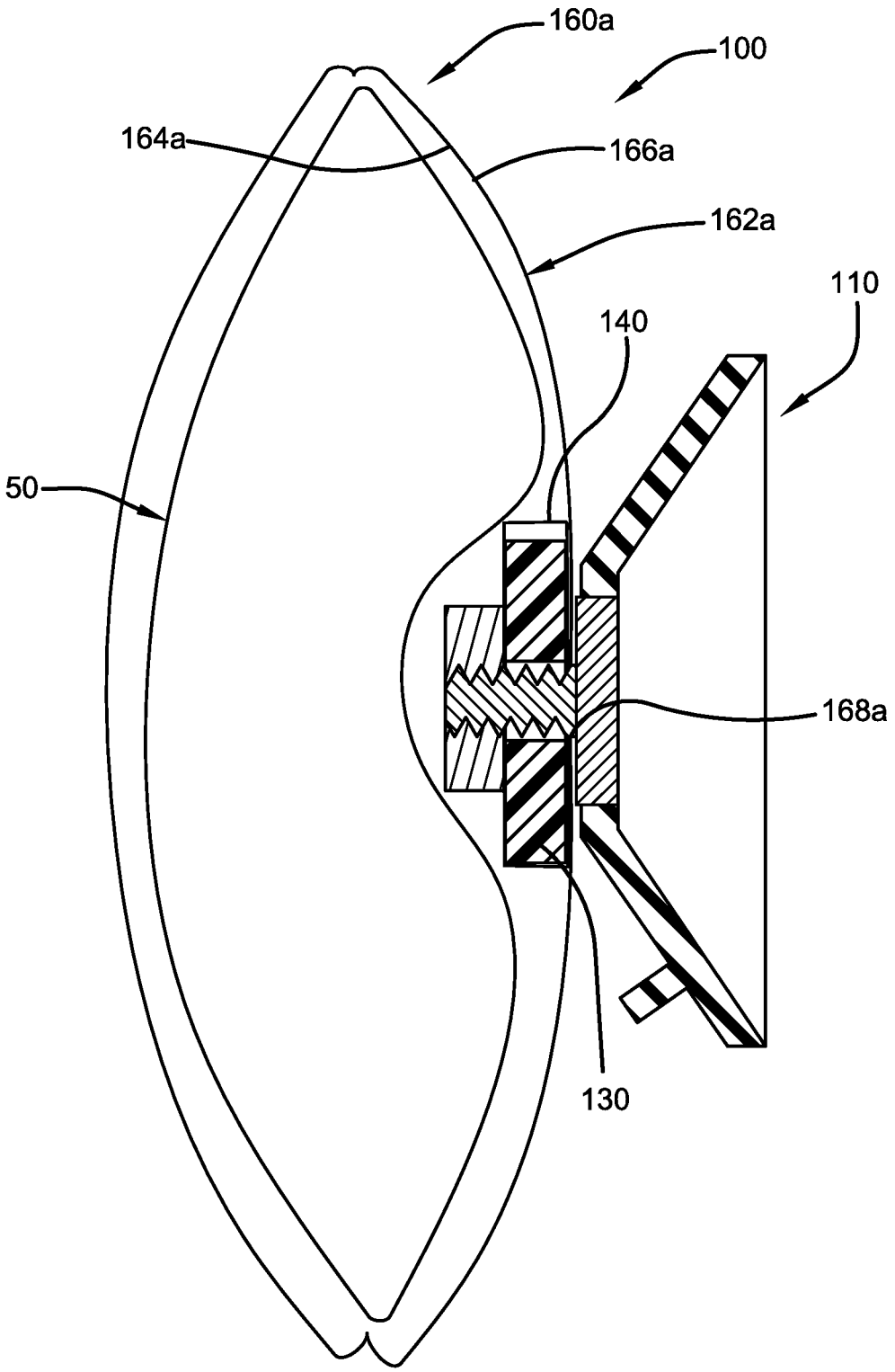
FIG. 10 illustrates an overhead perspective view the cornhole training device of the present invention for use with the cornhole game board and a cornhole bag in accordance with the disclosed architecture.
Figure 11:
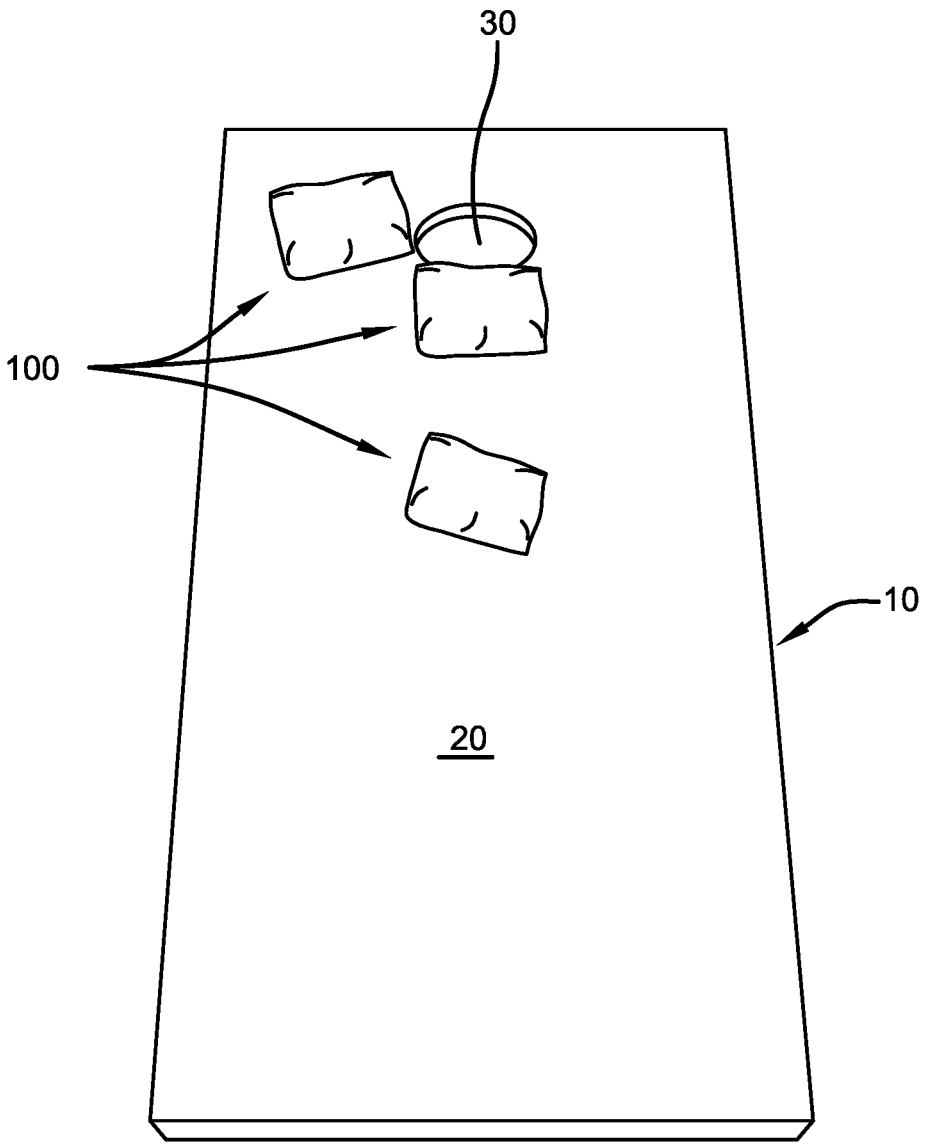
FIG. 11 illustrates an overhead perspective view of a plurality of the cornhole training devices of the present invention for use with the cornhole game board attached to a cornhole board in accordance with the disclosed architecture.

Alternatively, as illustrated in FIG. 10, the cornhole training device 100 further comprises a cornhole receiving bag **160*a* for encapsulating a traditional cornhole bag 50. The cornhole receiving bag 160*a* is simply a cornhole bag shell sized slightly larger than a traditional cornhole bag so that the cornhole receiving bag 160*a* can envelope and encapsulate the traditional cornhole bag. The cornhole receiving bag 160*a* comprises an interior surface 164*a* and an exterior surface 166*a*. A bag through hole 168*a* penetrates the cornhole board engaging side 162*a***.

Figure 6:
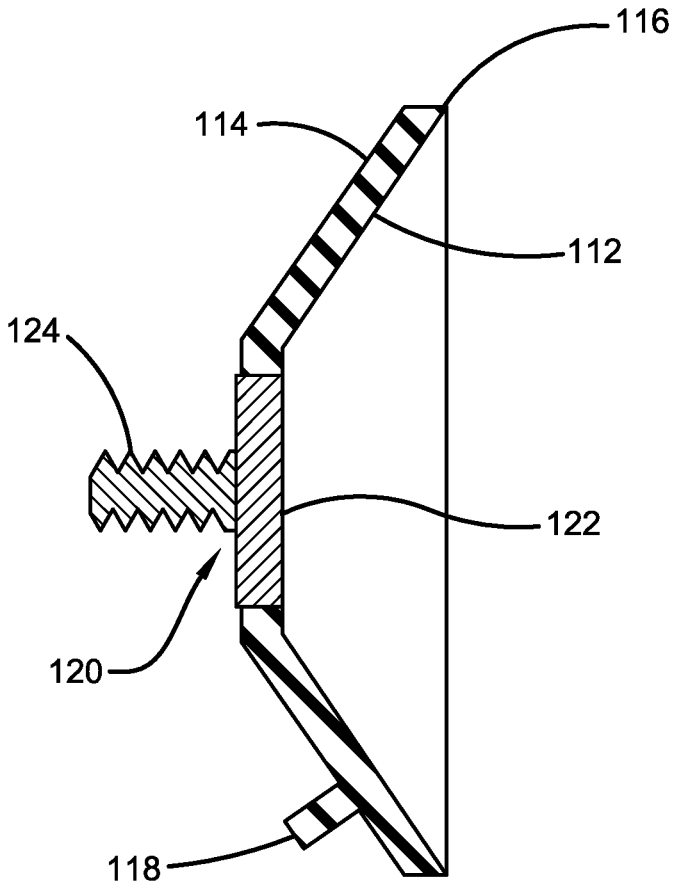
FIG. 6 illustrates a side cutaway view of a suction component of the cornhole training device of the present invention for use with the cornhole game board in accordance with the disclosed architecture.

The suction component 110 is configured to engage the cornhole gameboard 10 holding the cornhole training device 100 in place on the top surface 20 of the cornhole gameboard 10. As illustrated in FIG. 6, the suction component 110 comprises a concave side 112, a convex side 114, and a circular perimeter 116. The concave side 112, the convex side 114, and the circular perimeter 116 essentially form a suction cup. The concave side 112 is configured to secure the cornhole training device 100 to the cornhole board 10 via suction. The suction component 110 may further comprises a protuberance 118. The protuberance 118 is a knob or bump designed to allow the user to better grasp the suction component 110 to disengage it from the top surface 20 of the cornhole gameboard 10.

Figure 7:
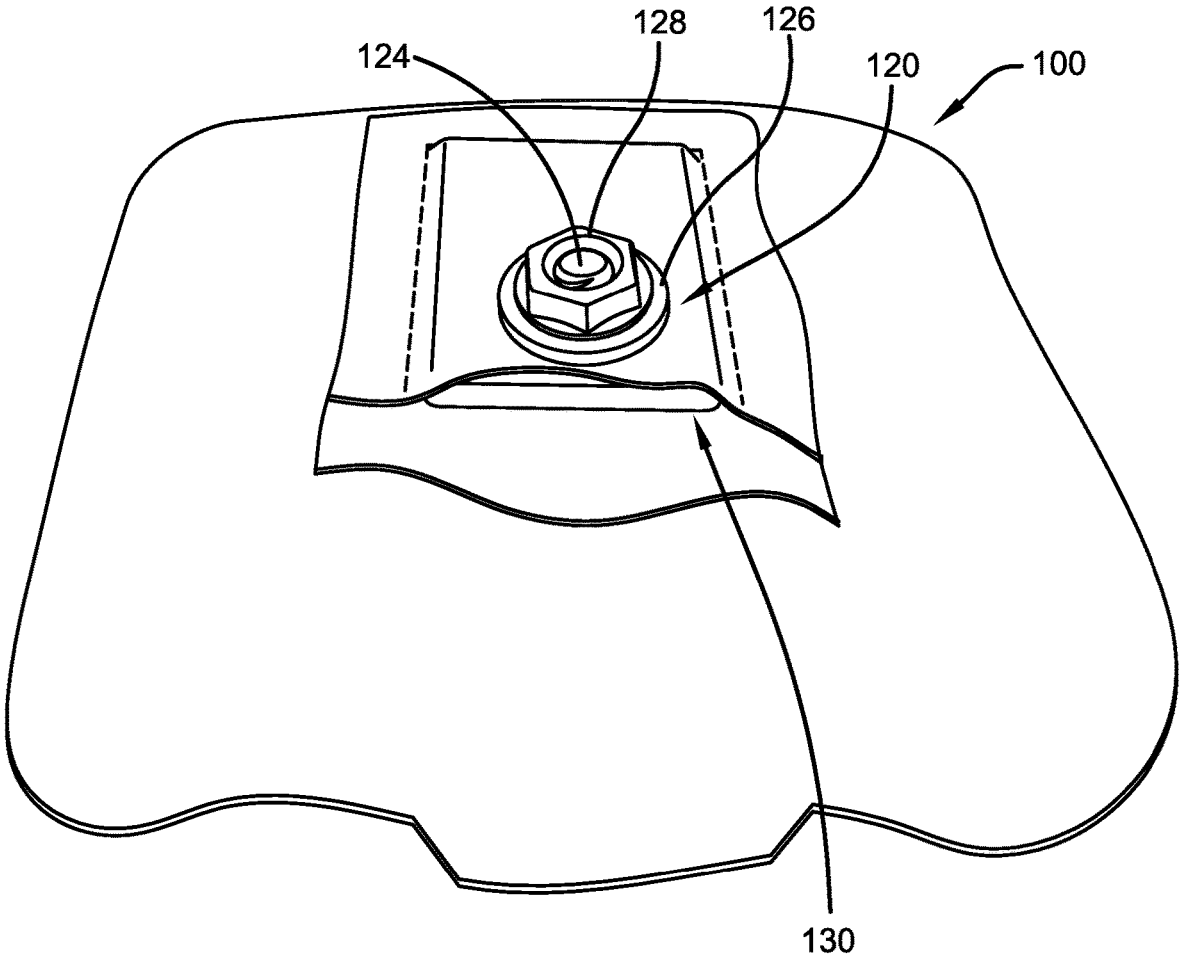
FIG. 7 illustrates a perspective view of various components of the cornhole training device of the present invention for use with the cornhole game board in accordance with the disclosed architecture.
Figure 8:
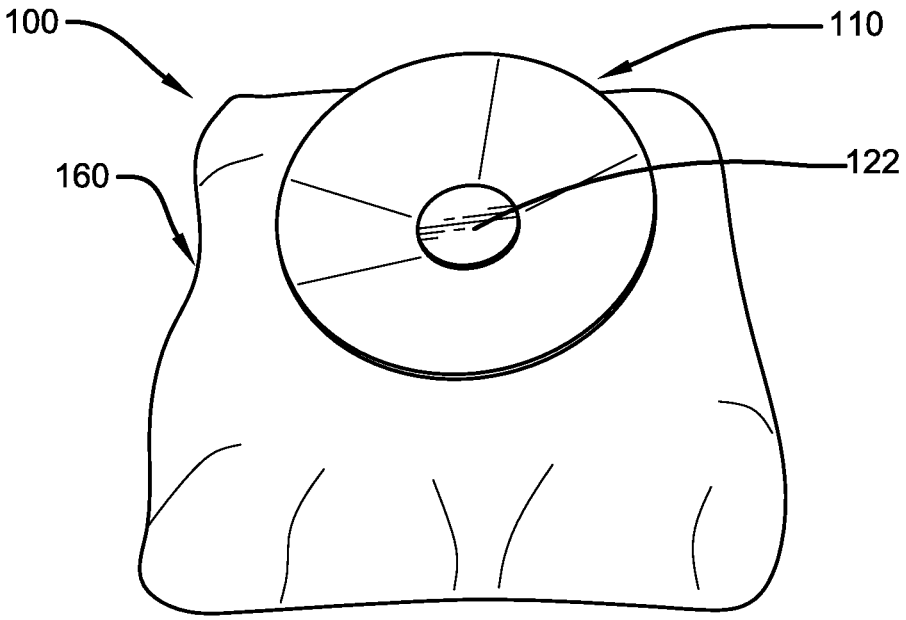
FIG. 8 illustrates a perspective view of the suction component and a cornhole bag of the cornhole training device of the present invention for use with the cornhole game board in accordance with the disclosed architecture

The suction component 110 further comprises an attachment component 120. The attachment component 120 comprises a center portion 122 and a connector element 124. The center portion 122 is integrated into the suction component 110 as illustrated in FIGS. 4 and 8. The center portion 122 may be a circular metal or plastic disc. The connector element 124 extends out of the center portion 122 from the convex side 114. The connector element 124 may be threaded or partially threaded. As illustrated in FIGS. 3, 4, and 7, the attachment component 120 may further comprise a spacer element 126 and a securing element 128. The spacing element 126 is typically a washer or similar spacer that is configured to fit over the connector element 124. The securing element 128 is typically a nut or similar mechanical fastener that engages the connector element 124.

As illustrated in FIGS. 3 and 4, the stabilizing plate 130 is a generally rectangular plate. This is advantageous as the rectangular shape is designed to fit the stabilizing plate retaining pocket 140 and limits the weight of the cornhole training device 100 so that it still feels like a normal cornhole bag. The stabilizing plate 130 is typically constructed from a light weight metal, plastic, or similar material and comprises a plate through hole 132. The plate through hole 132 is positioned off center on the stabilizing plate 130. This hole positioning on the stabilizing plate 130 is advantageous as it keeps the bottom of the cornhole bag 50 from flipping up in the air when hit by another cornhole bag.

Figure 5:
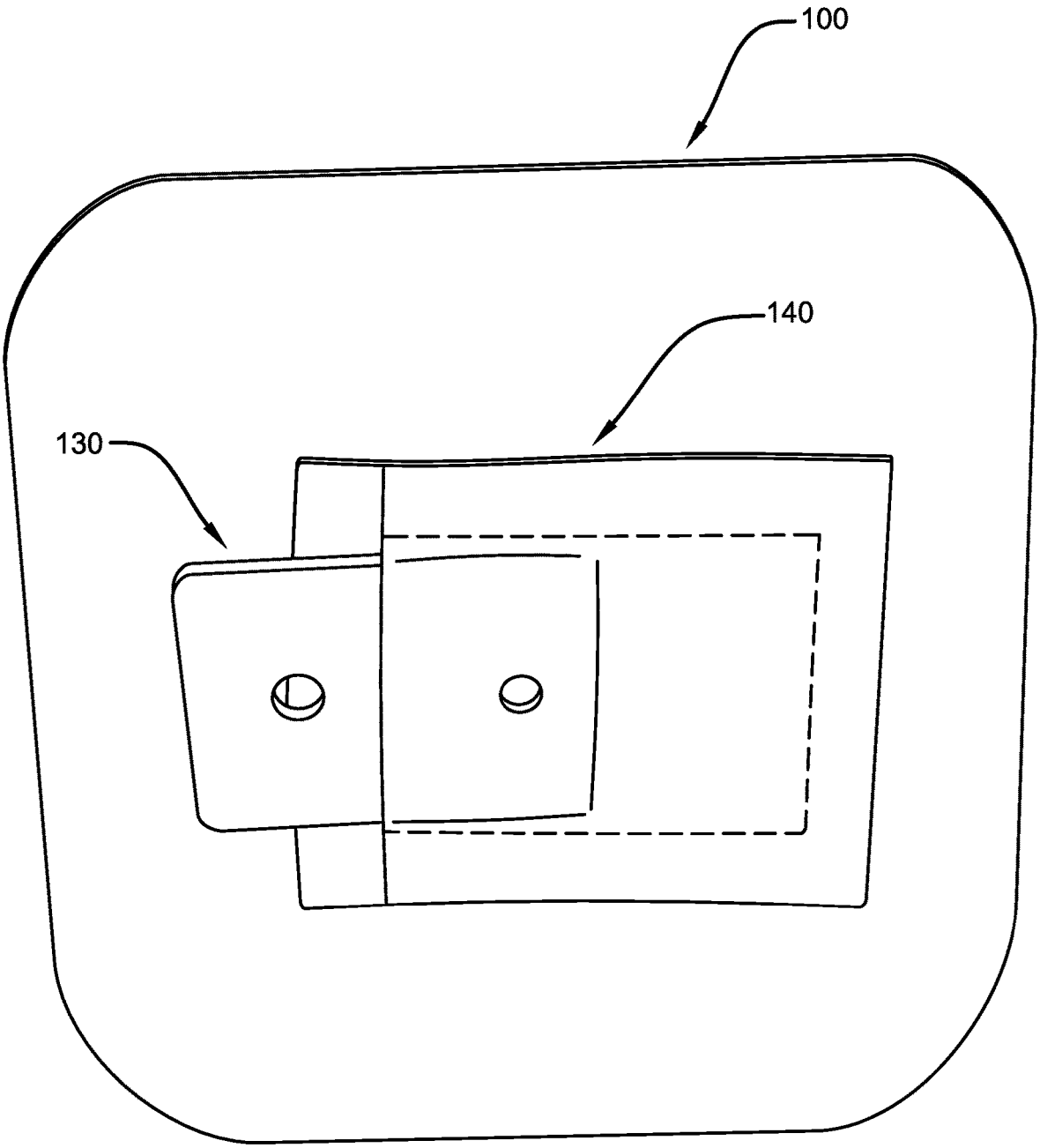
FIG. 5 illustrates a perspective view of a stabilizing plate being positioned within a stabilizing plate retaining pocket of the cornhole training device of the present invention for use with the cornhole game board in accordance with the disclosed architecture.

The stabilizing plate retaining pocket 140 comprises a pocket through hole 142. The stabilizing plate retaining pocket 140 further comprises a closable opening 144. The closable opening 144 is sized to accept the stabilizing plate 130. As illustrated in FIGS. 5 and 7, the stabilizing plate 130 is positional within the stabilizing plate retaining pocket 140 so that the plate through hole 132 and the pocket through hole 142 are aligned. The stabilizing plate retaining pocket 140 is securable to the interior surface 164 of the cornhole bag 160 via stitching, mechanical fasteners, adhesive, heat-sealing, or the like. Alternatively, the stabilizing plate retaining pocket 140 is securable to the interior surface **164*a* of the cornhole receiving bag 160*a***.

The suction component 110 is positioned so that the convex side 114 abuts the exterior surface 166, **166*a* of the cornhole bag 160 or the cornhole receiving bag 160*a* respectively. The connector element 124 of the attachment component 120 penetrates the through hole 168, 168*a* of the cornhole bag 160 or the cornhole receiving bag 160*a*. The connector element 124 further penetrates the pocket through hole 142 and the plate through hole 132. The connector element 124 extends through the stabilizing plate 130 and spacer element 126 and is secured with the securing element 128 as illustrated in FIG. 7. Alternatively, the connector element 122 may secure directly to the stabilizing plate 130. The plate through hole 132 may be threaded to accept the threaded connecter element 122** without the need for a nut or other mechanical fastener.

Figure 12:
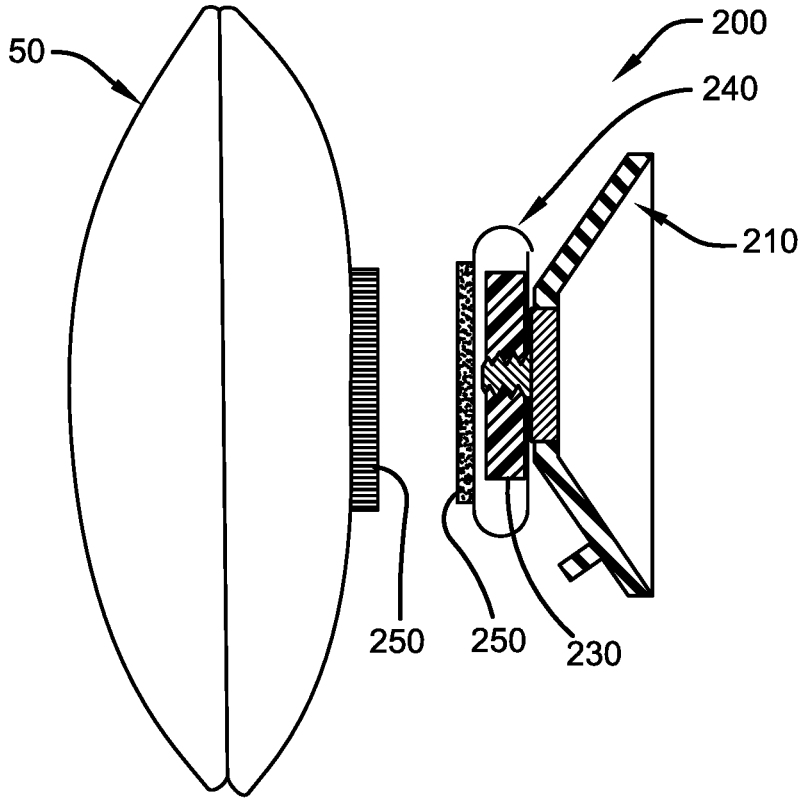
FIG. 12 illustrates a side view of a cornhole training device of the present invention for use with a cornhole bag and a cornhole game board in accordance with the disclosed architecture.
Figure 13:
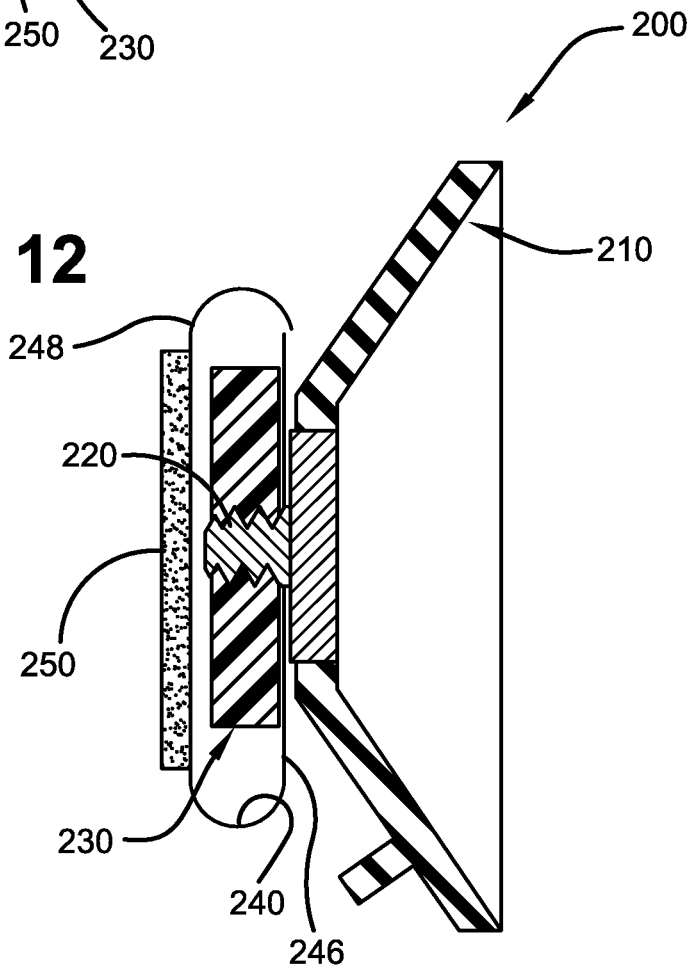
FIG. 13 illustrates a side cutaway view of the cornhole training device of the present invention for use with the cornhole bag and the cornhole game board in accordance with the disclosed architecture.

In another embodiment as illustrated in FIGS. 12 and 13, the subject matter disclosed and claimed herein comprises a cornhole training device 200. The cornhole training device 200 is adapted for use with a cornhole bag 50 and a cornhole gameboard 10. The cornhole training device 200 comprises a suction component 210, a stabilizing plate 230, and stabilizing plate retaining pocket 240. The suction component 210 is configured to engage the cornhole gameboard 10 holding the cornhole bag 50 and the cornhole training device 200 in place on a top surface 20 of the cornhole gameboard 10.

The suction component 210 comprises a concave side (similar to 112), a convex side (similar to 114), and a circular perimeter (similar to 116). The concave side, the convex side, and the circular perimeter essentially form a suction cup. The concave side is configured to secure the cornhole training device 100 to the cornhole board 10 via suction. The suction component 210 may further comprises a protuberance (similar to 118). The protuberance is a knob or bump designed to allow the user to better grasp the suction component 210 to disengage it from the top surface 20 of the cornhole gameboard 10.

The suction component 210 further comprises an attachment component 220. The attachment component 220 comprises a center portion (similar to 122) and a connector element (similar to 124). The center portion is integrated into the suction component 210. The center portion may be a circular metal or plastic disc. The connector element extends out of the center portion from the convex side. The connector element may be threaded or partially threaded. The attachment component 220 may further comprise a spacer element (similar to 126) and a securing element (similar to 128). The spacing element is typically a washer or similar spacer that is configured to fit over the connector element. The securing element is typically a nut or similar mechanical fastener that engages the connector element.

The stabilizing plate 230 is a generally rectangular plate. This is advantageous as the rectangular shape is designed to fit the stabilizing plate retaining pocket 240 and limits the weight of the cornhole training device 200. The stabilizing plate 230 is constructed from a light weight metal or plastic and comprises a plate through hole (similar to 132). The plate through hole is positioned off center on the stabilizing plate. This is advantageous as it keeps the bottom of the cornhole bag 50 from flipping up in the air when hit by another cornhole bag.

The stabilizing plate retaining pocket 240 comprises a pocket through hole (similar to 142). The stabilizing plate retaining pocket 240 further comprises a closable opening (similar to 144). The closable opening is sized to accept the stabilizing plate 230. The stabilizing plate retaining pocket 240 further comprises an outward facing side 246 and a cornhole bag facing side 248. The outward facing side 246 is removably attachable to the cornhole bag 50 via a bag attachment element 250. The bag attachment element 250 may be a hook and loop fastening component, a magnetic attachment, a mechanical fastener component, or the like.

The stabilizing plate 230 is positional within the stabilizing plate retaining pocket 240 so that the plate through hole and the pocket through hole are aligned. The stabilizing plate retaining pocket 240 is securable to an exterior surface of the cornhole bag 50 via stitching, mechanical fasteners, adhesive, heat-sealing, or the like.

The suction component 210 is positioned so that the convex side abuts an exterior surface of the cornhole bag 50. The connector element of the attachment component 220 penetrates the through hole the pocket through hole and the plate through hole. The connector element extends through the stabilizing plate 230 and spacer element and is secured with the securing element. Alternatively, the connector element may secure directly to the stabilizing plate 230. The plate through hole may be threaded to accept the threaded connecter element without the need for a nut or other mechanical fastener.

Notwithstanding the forgoing, the cornhole training devices 100 and 200 can be any suitable size, shape, and configuration as is known in the art without affecting the overall concept of the invention, provided that it accomplishes the above stated objectives. One of ordinary skill in the art will appreciate that the shape and size of the cornhole training devices 100 and 200 and their various components, as show in the FIGS. are for illustrative purposes only, and that many other shapes and sizes of the cornhole training devices 100 and 200 are well within the scope of the present disclosure. Although dimensions of the cornhole training devices 100 and 200 and their components (i.e., length, width, and height) are important design parameters for good performance, the cornhole training devices 100 and 200 and their various components may be any shape or size that ensures optimal performance during use and/or that suits user need and/or preference. As such, the cornhole training devices 100 and 200 may be comprised of sizing/shaping that is appropriate and specific in regard to whatever the cornhole training devices 100 and 200 are designed to be applied.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cornhole training device for use with a cornhole game board, the cornhole training device comprising:

a suction component comprising a concave side, a convex side, and an attachment component;

a stabilizing plate comprising a plate through hole;

a stabilizing plate retaining pocket comprising a pocket through hole, the retaining pocket configured to retain the stabilizing plate so that the plate and pocket through holes align; and a cornhole bag; and wherein the attachment component of the suction component penetrates both the plate and pocket through holes; and wherein the stabilizing plate retaining pocket is attachable to the cornhole bag, and wherein the suction component is configured to engage the cornhole gameboard holding the cornhole training device in place on a top surface of the cornhole gameboard.

2. The cornhole training device of claim 1, wherein the attachment component comprises a center portion integrated into the suction component and a connector element extending out of the convex side.

3. The cornhole training device of claim 2, wherein the connector element is threaded.

4. The cornhole training device of claim 2, wherein the attachment component further comprises a spacer element and a securing element for engaging the connector element.

5. The cornhole training device of claim 1, wherein the stabilizing plate retaining pocket is attachable to the cornhole bag via a hook and loop fastening component.

6. A cornhole training device for use with a cornhole game board, the cornhole training device comprising:

a suction component comprising a concave side, a convex side, and an attachment component;

a stabilizing plate comprising a plate through hole;

a stabilizing plate retaining pocket comprising a pocket through hole, the retaining pocket configured to retain the stabilizing plate so that the plate and pocket through holes align; and a cornhole bag; and wherein the stabilizing plate retaining pocket is securable to an interior surface of the cornhole bag;

wherein the attachment component of the suction component penetrates the plate through hole, the pocket through hole, and the cornhole bag; and wherein the suction component is configured to engage the cornhole gameboard holding the cornhole training device in place on a top surface of the cornhole gameboard.

7. The cornhole training device of claim 6, wherein the stabilizing plate is rectangular.

8. The cornhole training device of claim 6, wherein the stabilizing plate retaining pocket further comprises a closable opening sized to accept the stabilizing plate.

9. The cornhole training device of claim 6, wherein the stabilizing plate retaining pocket is stitched to the interior surface of the cornhole bag.

10. The cornhole training device of claim 6, wherein the attachment component comprises a center portion integrated into the suction component and a connector element extending out of the convex side.

11. The cornhole training device of claim 10, wherein the attachment component further comprises a spacer element and a securing element for engaging the connector element.

12. The cornhole training device of claim 11, wherein the spacer element is a washer and the securing element is a nut.

13. The cornhole training device of claim 10, wherein the connector element is threaded.

14. The cornhole training device of claim 13, wherein the plate through hole of the stabilizing plate is threaded for engaging the connector element.

15. The cornhole training device of claim 6, wherein the suction component further comprises a protuberance adjacent to a perimeter of the suction component.

16. The cornhole training device of claim 6, wherein the cornhole training device is temporarily positional on the cornhole game board to block an aperture in the cornhole board.

17. A cornhole training device for use with a cornhole game board, the cornhole training device comprising:

a suction component comprising a concave side, a convex side, and an attachment component;

a stabilizing plate comprising a plate through hole;

a stabilizing plate retaining pocket comprising a pocket through hole, the retaining pocket configured to retain the stabilizing plate so that the plate and pocket through holes align;

a corn hole bag; and a cornhole receiving bag for encapsulating the cornhole bag; and wherein the stabilizing plate retaining pocket is securable to an interior surface of the cornhole receiving bag;

wherein the attachment component of the suction component penetrates the plate through hole, the pocket through hole, and the cornhole receiving bag; and wherein the suction component is configured to engage the cornhole gameboard holding the cornhole training device in place on a top surface of the cornhole gameboard.

18. The cornhole training device of claim 17, wherein the attachment component comprises a center portion integrated into the suction component and a connector element extending out of the convex side.

19. The cornhole training device of claim 18, wherein the attachment component further comprises a spacer element and a securing element for engaging the connector element.

20. The cornhole training device of claim 17, wherein the cornhole training device is repositionable on the cornhole game board to block an aperture in the cornhole board.

* * * * *